US010350452B2

(12) United States Patent
McCarter

(10) Patent No.: US 10,350,452 B2
(45) Date of Patent: Jul. 16, 2019

(54) METHOD AND APPARATUS FOR AN EXERCISE DEVICE

(71) Applicant: Custom Product Innovations, Inc., Lebanon, IL (US)

(72) Inventor: Kyle Lee McCarter, Lebanon, IL (US)

(73) Assignee: Custom Product Innovtions, Inc., Lebanon, IL (US)

( * ) Notice: Subject to any disclaimer, the term of this patent is extended or adjusted under 35 U.S.C. 154(b) by 54 days.

(21) Appl. No.: 14/505,873

(22) Filed: Oct. 3, 2014

(65) Prior Publication Data

US 2015/0105225 A1 Apr. 16, 2015
US 2017/0216661 A9 Aug. 3, 2017

Related U.S. Application Data

(60) Provisional application No. 61/887,047, filed on Oct. 4, 2013.

(51) Int. Cl.

*A63B 23/02* (2006.01)
*A63B 21/00* (2006.01)
*A63B 71/00* (2006.01)

(52) U.S. Cl.

CPC ..... *A63B 23/0205* (2013.01); *A63B 21/4037* (2015.10); *A63B 21/4039* (2015.10); *A63B 23/0211* (2013.01); *A63B 71/0054* (2013.01)

(58) Field of Classification Search

CPC ..... A63B 2209/02; A63B 2209/08; A63B 2209/10; A63B 2209/14; A63B 21/4037; A63B 23/0205; A63B 71/0054; A63B 21/4039; A63B 23/0211; A63B 21/4035

See application file for complete search history.

(56) References Cited

U.S. PATENT DOCUMENTS

D233,200 S * 10/1974 Madl ..... D24/215
3,921,222 A * 11/1975 Hollman ..... A63B 71/12 2/463
4,231,125 A 11/1980 Titti
4,285,544 A * 8/1981 Zapf ..... A47C 3/16 297/218.3
4,335,725 A * 6/1982 Geldmacher ..... A61F 7/007 219/202
4,700,403 A * 10/1987 Vacanti ..... A63B 71/08 2/22

(Continued)

OTHER PUBLICATIONS

Product information for Baby Infant Newborn Sleep Positioner/ Prevent Flat Head Shape Pillow Safe Support as shown on ebay website, retrieved on Sep. 18, 2014, from http://www.ebay.com/itm/Baby-Infant-Newborn-Sleep-Positioner-Prevent-Flat-Head-Shape-Pillow-Safe-Support-/161128065996?pt=LH_DefaultDomai%E2%80%A6 (6 pgs).

(Continued)

*Primary Examiner* — Andrews S Lo
(74) *Attorney, Agent, or Firm* — Armstrong Teasdale LLP

(57) ABSTRACT

A method and a cushion extension for an exercise device are provided. The cushion extension includes a first portion covering a surface of the exercise device, the covered surface configured to contact the user during an exercise, a second portion extending from the first portion in a direction of the exercise, and a third portion and a fourth portion each joined to opposite ends of the first portion and each forming a method of attachment between each and the first portion.

8 Claims, 5 Drawing Sheets

(56) References Cited

U.S. PATENT DOCUMENTS 4,953,857 A * 9/1990 Lemire ..... A63B 21/078 482/104
4,987,625 A 1/1991 Edelson
5,066,001 A * 11/1991 Wilkinson ..... A63B 6/00 482/52
5,099,530 A 3/1992 Scott
5,168,576 A * 12/1992 Krent ..... A41D 13/0156 2/16
5,182,828 A 2/1993 Alivizatos
5,584,786 A * 12/1996 Almeda ..... A63B 21/00047 482/140
5,611,765 A * 3/1997 Koch, Jr. ..... A63B 23/03575 482/140
5,647,829 A * 7/1997 Rivas ..... A63B 23/0211 482/140
5,887,300 A 3/1999 Pond
5,987,675 A * 11/1999 Kim ..... A47C 20/026 5/632
6,623,270 B1 * 9/2003 Meldeau ..... A63B 21/00047 432/140
6,751,816 B1 * 6/2004 Wechsler ..... A45F 3/14 383/4
7,217,228 B2 * 5/2007 Marquez ..... A63B 21/055 482/122
7,665,165 B2 2/2010 Maganov
8,376,920 B2 * 2/2013 Anderson ..... A63B 23/0211 482/140
8,852,712 B1 * 10/2014 Diaz ..... A63B 21/4037 428/100
2004/0075315 A1 * 4/2004 Patrick ..... A47C 31/11 297/219.1
2005/0159279 A1 * 7/2005 Stangler ..... A63B 21/00047 482/148
2005/0264056 A1 * 12/2005 Hanberg ..... A47C 31/113 297/219.12
2006/0040811 A1 2/2006 Foster
2008/0214361 A1 * 9/2008 Oster ..... A63B 6/00 482/23
2011/0114235 A1 5/2011 Hartley
2012/0112502 A1 * 5/2012 Cristoforo ..... A47C 31/11 297/188.01
2012/0137433 A1 * 6/2012 Snell ..... A47C 31/007 5/493
2012/0227181 A1 * 9/2012 Cintas ..... A45C 3/00 5/420

OTHER PUBLICATIONS

Product information for Abs Exercise Cushion retrieved on Sep. 19, 2014 from website hppt://www.mama-inc.com.jp/en/products/living/item01.html (3 pgs).

* cited by examiner

METHOD AND APPARATUS FOR AN EXERCISE DEVICE

CROSS REFERENCE TO RELATED APPLICATIONS

This application claims priority to and the benefit of the filing date of U.S. Provisional Application No. 61/887,047 filed on Oct. 4, 2013, which is hereby incorporated by reference in its entirety.

BACKGROUND OF THE DISCLOSURE

The field of the invention relates generally to exercise equipment, and more specifically, to apparatus and methods for attachments to exercise devices.

At least some known exercise devices provide for assistance and/or additional resistance to a user during an exercise using the device through attachments or extensions added to the device during use. Some devices may be modified or "jury-rigged" by the user to make due during an exercise. For example, a rolled or folded towel may be used to provide cushioning when performing the exercise on a hard surface.

However, such modifications may shift or relocate itself during movements of the exercise, negating the attempted beneficial effects of the modification and reducing or eliminating the desired cushioning of the body during the exercise or modification of the device for use. Such shifting may also cause improper performance of the exercise or cause interruption of the exercise to readjust the modification. There is a need for secure support and cushioning for the user during exercise periods using abdominal and back muscle conditioning equipment.

BRIEF DESCRIPTION OF THE DISCLOSURE

In one embodiment, a cushion extension for an exercise device includes a first portion covering and/or attaching to a surface of the exercise device, the surface configured to contact the user during an exercise, a second portion extending from the first portion in a direction of the exercise, and a third portion and a fourth portion each joined to opposite ends of the first portion or on opposite sides of the first portion and each forming a method for attaching to the first portion, each method configured to receive a respective portion of the exercise device.

In another embodiment, a method of using a cover having a flap extension includes providing an exercise device cover, inserting a first edge of an exercise device within a first pocket of the cover, stretching the cover along a surface of the exercise device, inserting a second edge of the exercise device within a second pocket of the cover, and allowing the cover to rebound to apply a force along the surface that facilitates maintaining the cover affixed to the exercise device.

BRIEF DESCRIPTION OF THE DRAWINGS

FIG. 1 is a side view of a cover for an exercise device for exercising the upper and the lower abdominal muscles and the lower back of a user in accordance with an exemplary embodiment of the present invention.

FIG. 2 is a view of a backside of cover 100.

FIG. 3 is a view of a front side of the cover.

FIG. 4 is a plan view of an example blank of resilient material for forming the cover (shown in FIGS. 1, 2, and 3).

FIG. 5 is a flow diagram of an example method of using a cover having an integral flap extension in accordance with an example embodiment of the present disclosure.

DETAILED DESCRIPTION OF THE INVENTION

The following detailed description illustrates embodiments of the invention by way of example and not by way of limitation. It is contemplated that the invention has general application to embodiments of providing exercise in commercial and residential applications.

As used herein, an element or step recited in the singular and preceded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

Embodiments of the present disclosure describe a padded cover having flap extensions, also referred to as a burn guard. The padded cover encloses an existing exercise device configured to aid in the performance of a sit-up exercise. The attached padded flap extends under a tailbone of a user to facilitate reducing abrasion and or bruising of the tailbone area of the user that may occur during, for example, high-speed CrossFit "workout of the day" (WOD) sessions.

The padded extensions are formed of a resilient material such as, but, not limited to neoprene and extends under the tailbone, providing padding while using the user's bodyweight to prevent the exercise device from moving across the floor.

Figure 1:
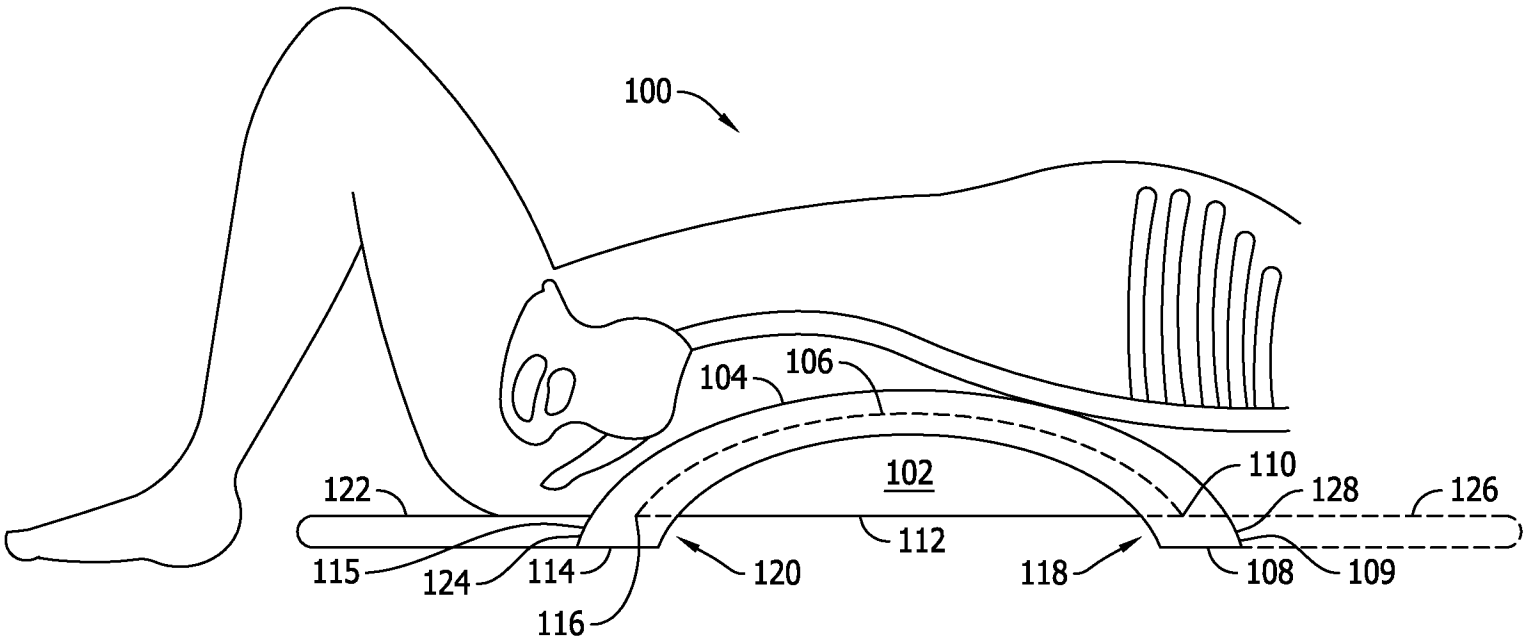
FIGS. 1-5 show example embodiments of the method and apparatus described herein.
Figure 2:
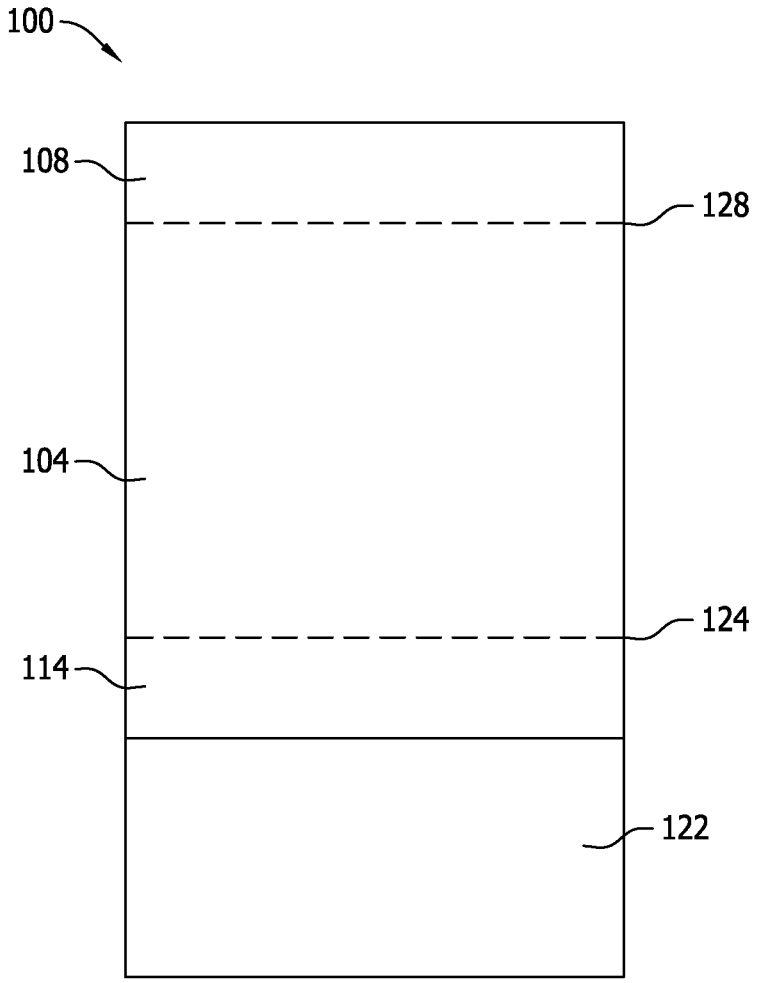
Figure 3:
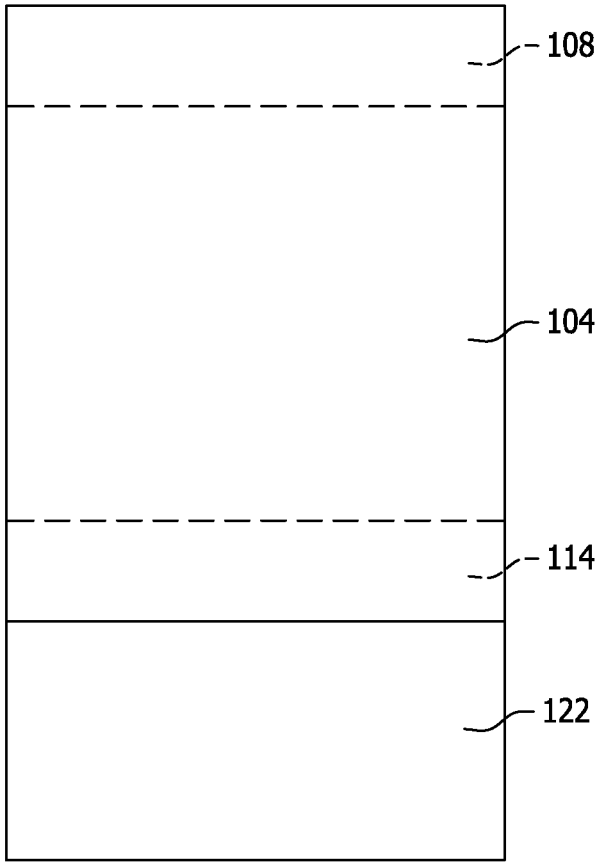

FIG. 1 is a side view of a cover 100 for an exercise device 102 for exercising the upper and the lower abdominal muscles and the lower back of a user in accordance with an exemplary embodiment of the present invention. FIG. 2 is a view of a backside of cover 100. FIG. 3 is a view of a front side of cover 100. In the example embodiment, cover 100 includes a first cover portion 104 shaped or formed to conform to an upper surface 106 of exercise device 102. Cover 100 also includes a second cover portion 108 coupled to first cover portion 104 at a first end 109 and shaped or formed to conform to a first edge 110 of exercise device 102 and to wrap around first edge 110 to extend along a bottom surface 112 of exercise device 102. Cover 100 also includes a third cover portion 114 coupled to first cover portion 104 at a second end 115 and shaped or formed to conform to a second edge 116 of exercise device 102 and to wrap around second edge 116 to extend along bottom surface 112 of exercise device 102 toward second cover portion 108. Second cover portion 108 and first cover portion 104 form a first pocket 118 and/or other method of securing cover 100 to exercise device 102. First pocket 118 is configured to receive first edge 110. Third cover portion 114 and first cover portion 104 form a second pocket 120 and/or other method of securing cover 100 to exercise device 102. Second pocket 120 is configured to receive second edge 116. Cover portions 104, 108, and 114 may be formed of a resilient material such as, but not limited to urethane, foamed urethane, polyethylene, or combinations thereof. All of cover portions 104, 108, and 114 may be formed of the same resilient material or different materials and may be configured to stretch when applied to exercise device 102 to maintain cover 100 affixed to exercise device 102.

Cover 100 also includes a first extension flap 122 extending away from a first joint 124 between first cover portion 104 and third cover portion 114. In various embodiments, first extension flap 122 is formed of the resilient material. In other embodiments, first extension flap 122 is formed of two layers of the resilient material. In some embodiments, cover 100 may include a second extension flap 126 extending away from a second joint 128 between first cover portion 104 and second cover portion 108. In various embodiments, second extension flap 126 is formed of the resilient material. In other embodiments, second extension flap 126 is formed of two layers of the resilient material. In some embodiments, cover may contain various different flaps in different directions for securing exercise device during use.

Figure 4:
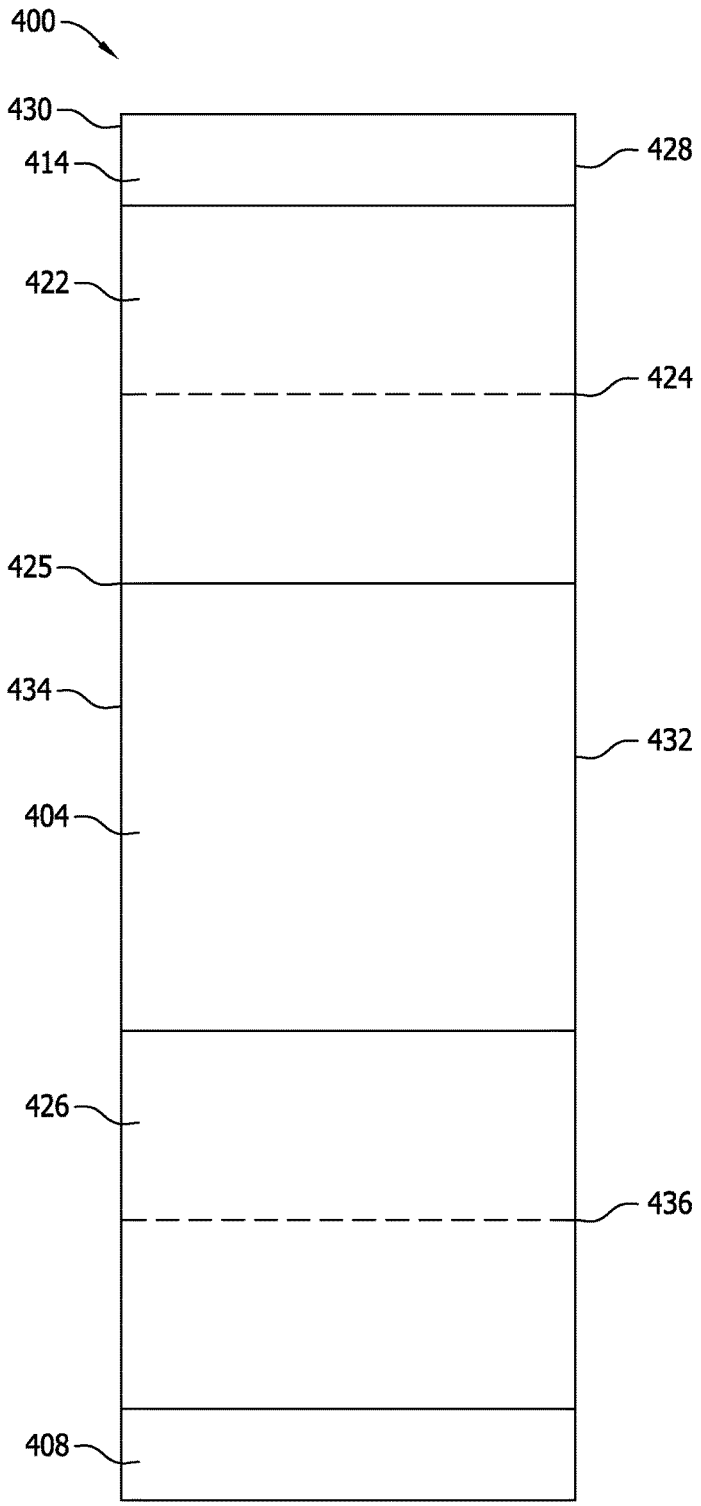

FIG. 4 is a plan view of an example blank 400 of resilient material for forming cover 100 (shown in FIGS. 1, 2, and 3). In the example embodiment, blank 400 includes a first blank section 404, which corresponds to first cover portion 104 of cover 100. In one embodiment, blank 400 includes a second blank section 422, which corresponds to first extension flap 122 (shown in FIGS. 1, 2, and 3). Second blank section 422 may include a second blank section fold line 424 or second blank section 422 may simply be folded during fabrication in approximately the area shown by second blank section fold line 424. Folding second blank section 422 along second blank section fold line 424 positions a first pocket blank section 414, which corresponds to third cover portion 114 (shown in FIGS. 1, 2, and 3) proximate an edge 425 between first blank section 404 and second blank section 422. First pocket blank section lateral edges 428 and 430 of first pocket blank section 414 can be coupled to first blank portion lateral edges 432 and 434 of first blank section 404 to form second pocket 120 (shown in FIG. 1). Similarly, in some embodiments, blank 400 may include a third blank section 426 having a third blank section fold line 436, and a second pocket blank section 408 that can be folded under to form first pocket 118 (shown in FIG. 1).

Figure 5:
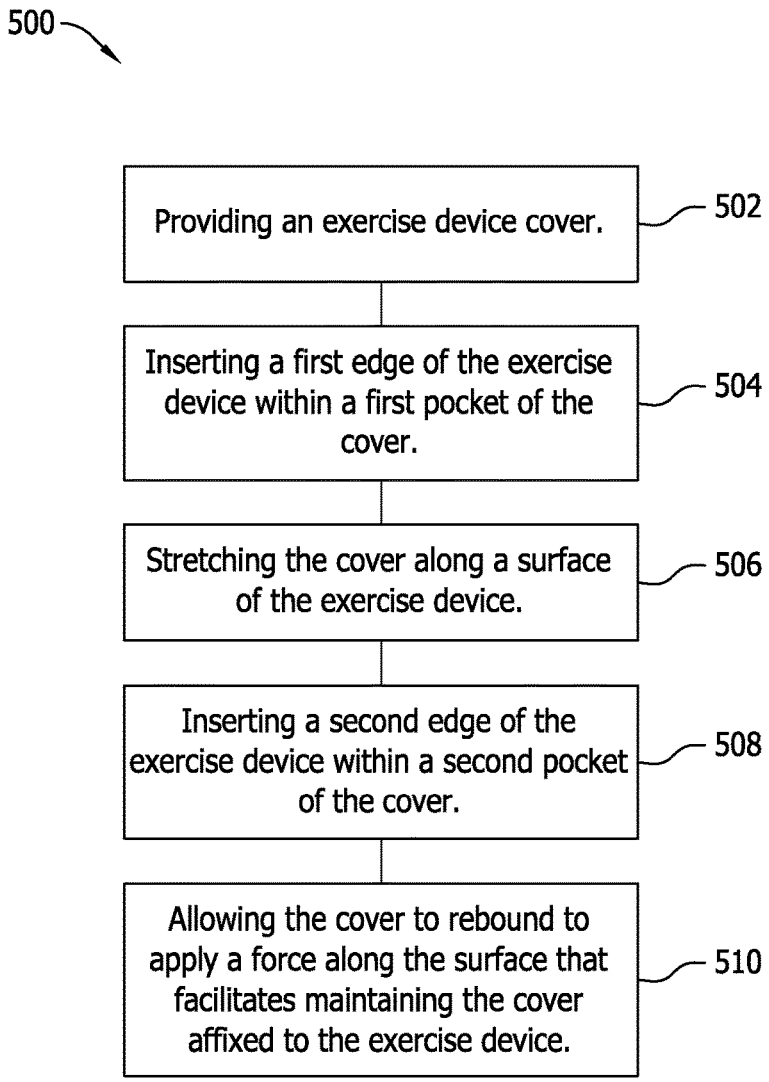

FIG. 5 is a flow diagram of a method 500 of using a cover having an integral flap extension in accordance with an example embodiment of the present disclosure. In the example embodiment, method 500 includes providing 502 an exercise device cover, inserting 504 a first edge of the exercise device within a first pocket of the cover, stretching 506 the cover along a surface of the exercise device. Method 500 also includes inserting 508 a second edge of the exercise device within a second pocket of the cover and allowing 510 the cover to rebound to apply a force along the surface that facilitates maintaining the cover affixed to the exercise device.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A cushion extension for an exercise device, the cushion extension comprising:

a first cover portion formed of a resilient material configured to stretch over and to conform to a shape of an upper surface of the exercise device, the first cover portion configured to contact a user during an exercise;

a second cover portion joined to the first cover portion at a first joint at a first end of the first cover portion, the second cover portion at least partially covering a bottom surface of the exercise device and forming a first pocket with the first cover portion, the first pocket configured to receive a first edge of the exercise device; and a third cover portion joined to the first cover portion at a second joint at a second end of the first cover portion, the third cover portion at least partially covering the bottom surface of the exercise device and forming a second pocket with the first cover portion, the second pocket configured to receive a second edge of the exercise device opposite the first edge, wherein the stretched first cover portion affixes the first edge and the second edge of the exercise in the first pocket and the second pocket, respectively; and a first padded flap extending away from the first cover portion in a first direction at the first joint between the first padded flap and the first cover portion, the first padded flap extending away from the first cover portion parallelly to the third cover portion.

2. The cushion extension of claim 1, wherein any of the first, second, and third cover portions are formed of a layer comprising urethane.

3. The cushion extension of claim 1, wherein any of the first, second, and third cover portions are formed of a layer comprising foamed urethane.

4. The cushion extension of claim 1, wherein any of the first, second, and third cover portions are formed of a layer comprising foamed urethane and polyethylene.

5. The cushion extension of claim 1, wherein the second cover portion is formed integrally with the first cover portion.

6. The cushion extension of claim 1, wherein the second cover portion is hingedly coupled to the first cover portion at a joint between the first and second cover portions.

7. The cushion extension of claim 1, wherein the cushion extension includes an arcuate cross-section.

8. The cushion extension of claim 1, wherein the first padded flap is configured to receive a posterior area of the user during use.

* * * * *